US008037808B2

(12) United States Patent
Bergmann

(10) Patent No.: US 8,037,808 B2
(45) Date of Patent: Oct. 18, 2011

(54) AXIAL PISTON MACHINE

(75) Inventor: Martin Bergmann, Schaafheim (DE)

(73) Assignee: Linde Material Handling GmbH (DE)

( * ) Notice: Subject to any disclaimer, the term of this patent is extended or adjusted under 35 U.S.C. 154(b) by 494 days.

(21) Appl. No.: 12/241,237

(22) Filed: Sep. 30, 2008

(65) Prior Publication Data

US 2009/0095149 A1 Apr. 16, 2009

(30) Foreign Application Priority Data

Oct. 15, 2007 (DE) ..... 10 2007 049 393

(51) Int. Cl.
*F01B 13/04* (2006.01)
*F01B 3/00* (2006.01)

(52) U.S. Cl. ..... 92/57; 92/71

(58) Field of Classification Search ..... 92/57, 71; 91/499

See application file for complete search history.

(56) References Cited

U.S. PATENT DOCUMENTS

| | | | | |
|---|---|---|---|---|
| 3,807,283 | A * | 4/1974 | Alderson et al. | 91/499 |
| 4,872,394 | A | 10/1989 | Nakagawa et al. | |
| 5,046,403 | A * | 9/1991 | Riedhammer | 92/57 |
| 5,730,042 | A * | 3/1998 | Engel | 92/71 |
| 5,862,704 | A * | 1/1999 | Seljestad | 92/71 |
| 2003/0138331 | A1 | 7/2003 | Fox et al. | |

FOREIGN PATENT DOCUMENTS

DE 10 2005 047 981 A1 4/2007

* cited by examiner

*Primary Examiner* — Michael Leslie
(74) *Attorney, Agent, or Firm* — The Webb Law Firm

(57) ABSTRACT

An axial piston machine utilizing a swashplate design has a cylinder drum (3) that is mounted so that it can rotate around an axis of rotation (2). The cylinder drum (3) is provided with cylinder bores (4), in each of which a piston (5) is mounted so that it can be displaced longitudinally. The pistons (5) are each supported by a sliding shoe (7) on a swashplate (8). The sliding shoes (7) are in a functional connection by means of a retaining device (16), in particular a retaining plate (15), that rotates synchronously with the cylinder drum (3). The sliding shoes (7) are in a functional connection with a moment generating device (25), by means of which an opposing moment can be generated on the sliding shoes (7) that counteracts the tipping moment.

12 Claims, 7 Drawing Sheets

3
9
7
14
13
A
28
8
7a
1
10
2
6
19
11
4
5
18
17
16
15
A

AXIAL PISTON MACHINE

CROSS REFERENCE TO RELATED APPLICATION

This application claims priority to German application DE 10 2007 049 393.4, filed Oct. 15, 2007, which is herein incorporated by reference in its entirety.

BACKGROUND OF THE INVENTION

1. Field of the Invention

This invention relates to an axial piston machine utilizing a swashplate design. A cylinder drum is mounted so that it can rotate around an axis of rotation. The cylinder drum is provided with cylinder bores, in each of which a piston is mounted so that it can be displaced longitudinally. The pistons are each supported by a sliding shoe on a swashplate. The sliding shoes are in a functional connection by a retaining device, in particular a retaining plate, that rotates synchronously with the cylinder drum.

2. Technical Considerations

On axial piston machines of this general type that are in the form of swashplate machines, the pistons are each supported on the swashplate by a sliding shoe. A sliding shoe ball-and-socket joint is located between the piston and the sliding shoe. When the swashplate machine is in operation, on account of the centrifugal forces acting on the sliding shoe, a tipping moment occurs on the sliding shoes which causes a tipping of the sliding shoes from the swashplate. By means of the retaining device, the sliding shoes are pressed toward the swashplate to prevent a lifting or tipping of the sliding shoes as a result of the tipping moment.

The retaining device can be in the form of a non-positive retaining device, whereby a spring device is provided which pushes the retaining device (and thus the sliding shoe) toward the swashplate. To prevent a tipping of the sliding shoes on account of the centrifugal forces that occur during operation, the spring force of the spring device must be designed for the maximum speed of rotation. However, that requires high spring forces which, during operation at lower speeds of rotation, generate high application forces of the sliding shoes against the swashplate and of the cylinder drum against the control surface. The result is the generation of high friction forces which adversely affect the efficiency of the swashplate machine. In addition, the high application forces lead to increased wear of the swashplate machine.

The retaining device can also be realized in the form of a positive or interlocking retaining device fastened on the housing in the axial direction. On account of the play that is present in the positive or interlocking connection of the retaining device with the housing, the sliding shoes can tip away from the swashplate on account of the centrifugal force that occurs during operation. As a result of which, leaks occur which can reduce the efficiency of the swashplate machine.

An axial piston machine of the general type described above in the form of a swashplate machine is described in DE 10 2005 047 981 A1, herein incorporated by reference.

Therefore, it is an object of the invention to provide a hydrostatic axial piston machine of the general type described above but which has improved efficiency.

SUMMARY OF THE INVENTION

The invention teaches that the sliding shoes are in a functional connection with a moment generating device, by means of which an opposing moment can be generated on the sliding shoes that counteracts the tipping moment. The teaching of the invention is, therefore, to generate an opposing moment that counteracts the tipping moment that is produced by the centrifugal forces on the sliding shoes by means of the moment generating device to compensate for some or all of the tipping moment. On a non-positive retaining device that is acted upon by a spring device, the spring force (and thus the application force) can be reduced. As a result of which, there are lower friction forces and thus an improved efficiency of the swashplate machine. The wear on the swashplate machine is also reduced on account of the reduced application force. With a positive or interlocking retaining device, the moment generating device reliably prevents a tipping of the sliding shoes. As a result of which, a swashplate machine of the invention has lower leakage and thus higher efficiency.

In one embodiment of the invention, the moment generating device is formed by rocker arms. One rocker arm is associated with each sliding shoe, by means of which a contact force that is exerted on the sliding shoe can be generated which is directed opposite to the centrifugal force that is exerted on the sliding shoe. Using rocker arms, it is easily possible to generate a contact force that acts on the sliding shoe and counteracts the centrifugal force and, thus, an opposing moment can be generated that counteracts the tipping moment caused by the centrifugal force.

It is particularly advantageous if the rocker arm is mounted on the retaining device so that it can pivot around a pivoting axis that is oriented parallel to the axis of rotation of the retaining device and can be brought into functional contact with the peripheral surface of the sliding shoe. As a result, little construction effort is required to generate the contact force that is exerted on the sliding shoes and counteracts the centrifugal force.

In one embodiment of the invention, the rocker arm can be brought into a functional connection with the peripheral surface of the sliding shoe in the vicinity of the neck of a sliding shoe.

In an additional embodiment of the invention, it is also advantageous if the rocker arm can be brought into a functional connection with the peripheral surface of the sliding shoe in the vicinity of a sliding shoe plate of the sliding shoe.

It is particularly advantageous if the rocker arm is realized in the form of a two-armed lever. A contact surface that can be brought into connection with the sliding shoe is realized in an area of the rocker arm that is provided with a first lever arm. The center of mass of the rocker arm is applied to a second lever arm. The rocker arm is thereby activated by the centrifugal force. As a result of which, the contact force is proportional to the centrifugal force applied to the rocker arm and thus proportional to the speed of rotation of the swashplate machine. Using such rocker arms that are activated by centrifugal force little construction effort is required to generate an opposing moment that counteracts the tipping moment on the sliding shoes.

It is particularly advantageous if the second lever arm is larger than the first lever arm. As a result of which, for a given rocker arm mass, a large contact force that acts on the sliding shoe can be achieved and thus a high opposing moment can be generated using rocker arms that do not occupy a great deal of space.

In one development of the invention, the mass of the rocker arm and the first arm and the second arm are designed so that the opposing moment generated by the rocker arm compensates for all or almost all of the tipping moment that acts on the sliding shoe.

If the rocker arm is wrapped partly around the sliding shoe and the area of the rocker arm that is provided with the second lever arm at least partly fills up the space between two neighboring sliding shoes, an appropriate rocker arm mass can be made available without requiring additional space for the rocker arm.

In one embodiment of the invention, the rocker arms can be located between the retaining device and the swashplate.

It is also possible to locate the rocker arm, as in an additional embodiment of the invention, between the retaining device and the cylinder drum.

It is advantageous in terms of little construction effort if, to mount the rocker arm on the retaining device, a bearing component, such as a cylindrical dowel, is provided. The rocker arms can each be mounted easily and pivotably on the retaining device by a cylindrical dowel.

The moment generating device formed by the rocker arms can be used in a swashplate machine with a non-positive retaining device which is pushed by a spring device toward the swashplate.

The moment generation device formed by the rocker arms can also be used in a swashplate machine with a positive or interlocking retaining device in which the retaining device is supported on a housing of the axial piston machine.

BRIEF DESCRIPTION OF THE DRAWINGS

Additional advantages and details of the invention are explained in greater detail below with reference to the exemplary embodiments illustrated in the accompanying schematic drawings whereupon like reference numbers identify like parts throughout, in which.

DESCRIPTION OF THE PREFERRED EMBODIMENT

Figure 1:
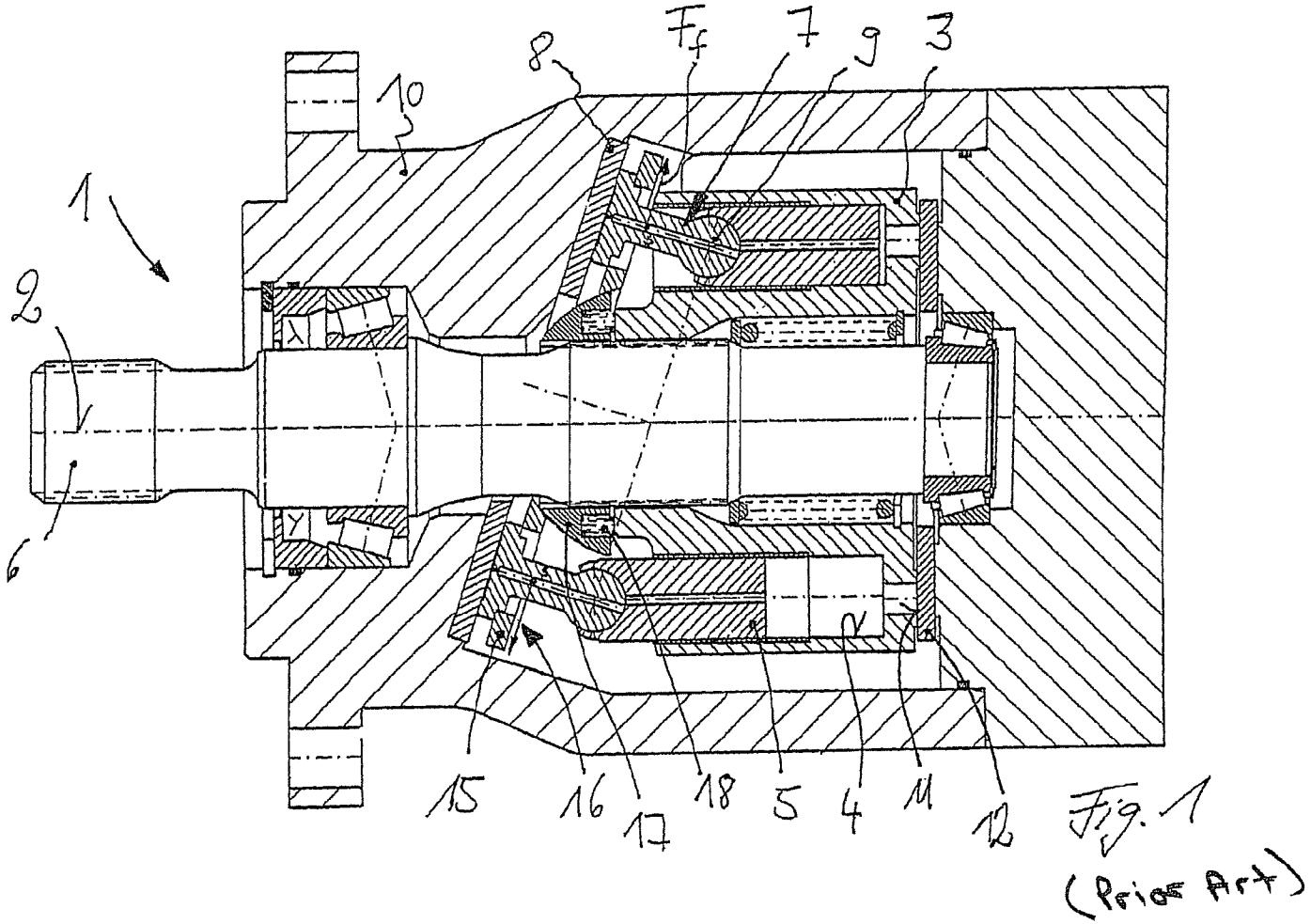
Fig. 1 (Prior Art)
FIG. 1 is an axial piston machine of the prior art utilizing a swashplate design, shown in longitudinal section.

FIG. 1 shows, in longitudinal section, a hydrostatic piston machine of the prior art in the form of a swashplate machine 1.

The swashplate machine 1 has a cylinder drum 3 that is mounted so it can rotate around an axis of rotation 2 and is provided with a plurality of concentrically arranged cylinder bores 4, in each of which a piston 5 is mounted so that it can be displaced longitudinally. The cylinder drum 3 is non-rotationally connected with a drive shaft 6 which is concentric with the axis of rotation 2.

The pistons 5 are each supported on a swashplate 8 by a sliding element which is realized in the form of a sliding shoe 7. The sliding shoe 7 is flexibly connected with an associated piston 5 by means of a sliding shoe ball-and-socket joint 9. As illustrated in FIG. 1, the swashplate 8 can be molded onto a housing 10 of the swashplate machine 1, whereby the swashplate machine 1 has a fixed displacement volume. It is also possible, however, to realize the swashplate 8 so that it can be adjusted, i.e., tilted. As a result of which, the swashplate machine 1 has a variable displacement volume.

The cylinder drum 3 is supported in the axial direction on a control surface 11 which is stationary on the housing 10 and which is realized on a disc-shaped control plate 12. The control plate 12 is provided with kidney-shaped control slots (not shown) which form an inlet connection and an outlet connection of the swashplate machine 1. Examples of such control slots are described in DE 10 2007 049 401.9 and DE 10 2007 049 389.6, both herein incorporated by reference.

The sliding shoes 7 are in a functional connection with a retaining device 16 which is realized in the form of a disc-shaped retaining plate 15. In the swashplate machine 1 illustrated in FIG. 1, the retaining device 16 is in the form of a non-positive retaining device. In this case, the retaining plate 15 is mounted on a spherical bearing component 17 which is supported on the cylinder drum 3 by a spring device 18 formed by one or more springs. The sliding shoes 7 are thereby pushed toward the swashplate 8 by the spring device 18 via the bearing component 17 and the retaining plate 15.

Figure 2:
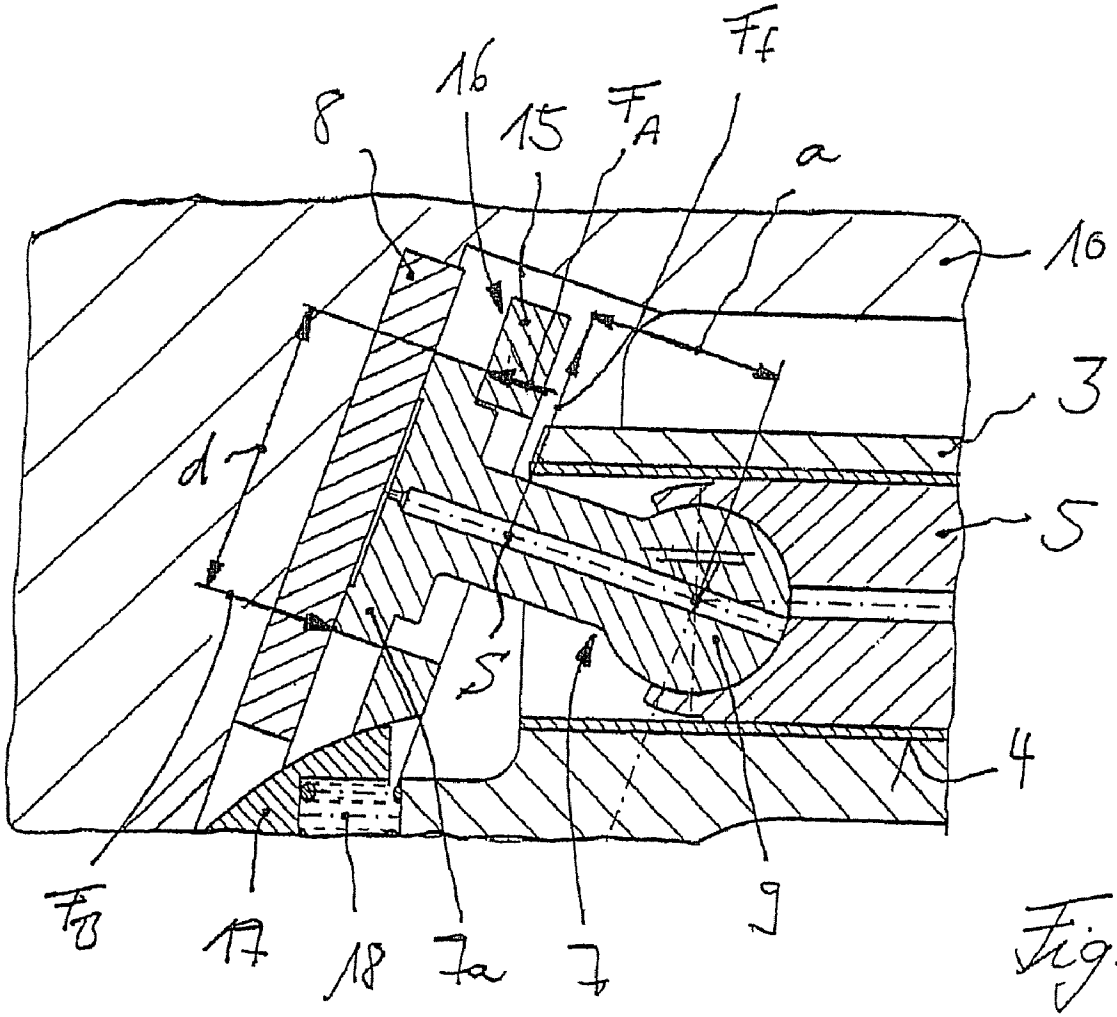
Fig. 2 (Prior Art)
FIG. 2 is a non-positive retaining device of the prior art.

FIG. 2 shows, in an enlarged illustration, a sliding shoe 7 from FIG. 1, wherein the forces that occur during operation of the swashplate machine 1 are indicated.

During rotation of the cylinder drum 3 around the axis of rotation 2, a centrifugal force $F_f$ occurs which is applied to the center of gravity S of the sliding shoe 7 and at the distance "a" from the center of gravity S of the sliding shoe 7 from the center of the sliding shoe ball-and-socket joint 9, which generates a tipping moment which tips the sliding shoe 7 from the swashplate 8. The tipping of the sliding shoe 7 from the swashplate 8 is prevented by forces $F_A$ and $F_B$ which act between the swashplate 8 and the sliding shoe 7 and between the sliding shoe 7 and the retaining plate 15, which are at the distance of the diameter "d" of a circular sliding shoe plate 7, by means of which the sliding shoe 7 is supported on the swashplate 8 and generate a moment that counteracts the tipping moment. The application force $F_A$ is applied by the spring device 18 that acts on the retaining plate 15.

To securely prevent a tipping of the sliding shoe 7 from the swashplate 8, the spring force of the spring device 18 is designed for the high centrifugal forces $F_f$ that occur at the maximum speed of rotation. At lower speeds of rotation, these high and unnecessary application forces $F_A$ lead to increased friction losses and thus to a reduced efficiency of the swashplate machine 1 as well as to increased wear of the swashplate machine 1.

Figure 3:
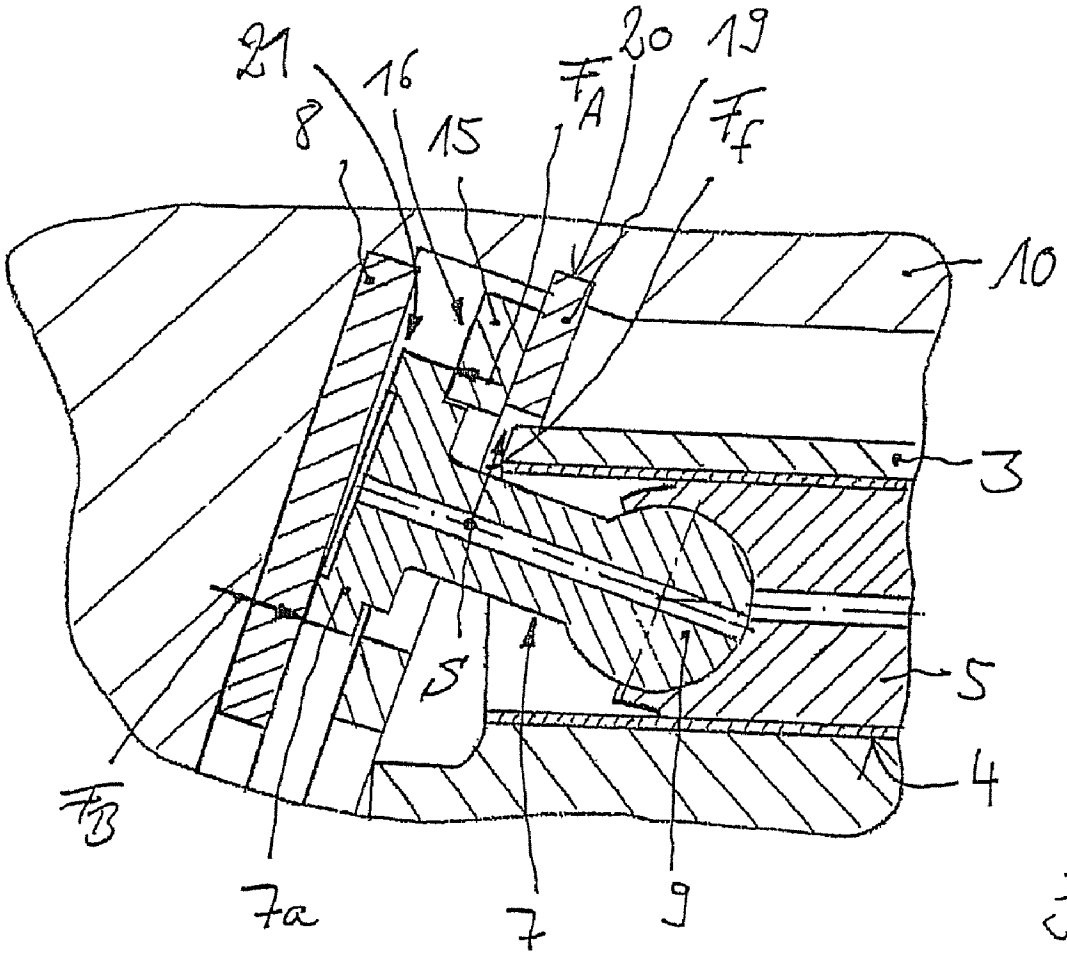
Fig. 3 (Prior Art)
FIG. 3 is a positive or interlocking retaining device of the prior art.

FIG. 3 shows a swashplate machine of the prior art with a positive or interlocking retaining device 15 in a view like the one in FIG. 2.

The disc-shaped retaining plate 15 is fastened on the housing 10 in the axial direction by means of, for example, a fastening device 19 formed by a Seeger circlip ring which is located in a groove-shaped recess 20 of the housing 10.

The tipping moment of the sliding shoe 7 caused by the centrifugal force $F_f$ in turn acts in opposition to the moment formed from the forces $F_A$ and $F_B$. On account of the play in the fastening device 19 that is present as a result of manufacturing and assembly tolerances, however, the sliding shoe 7 tips away from the swashplate 8. As a result of which, a gap 21 is formed between the sliding shoe plate 7*a* of the sliding shoe 7 and the swashplate 8, through which a leakage flow into the interior of the housing occurs, which leads to a reduction in the efficiency of the swashplate machine.

Figure 4:
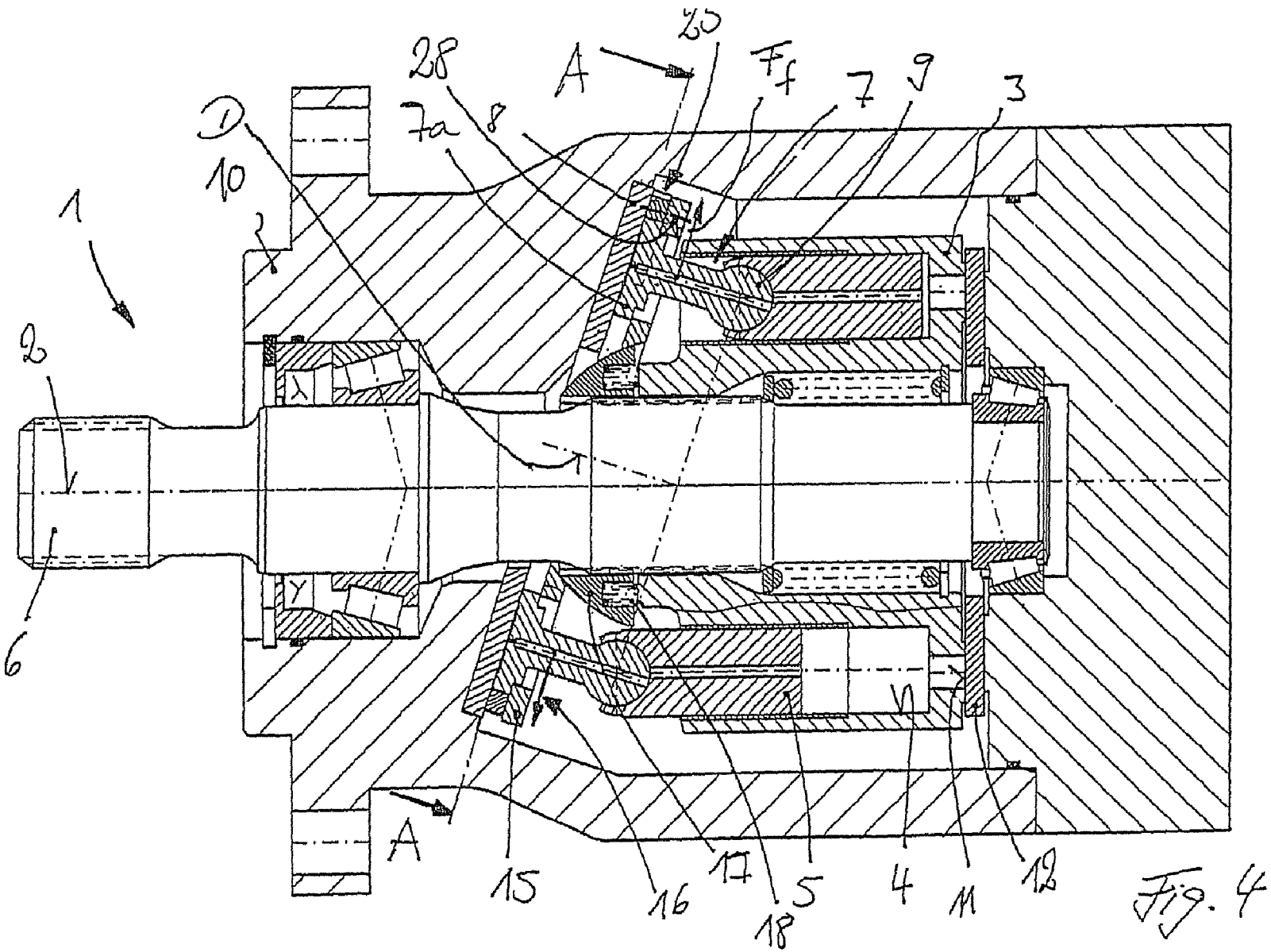
FIG. 4 is an axial piston machine incorporating features of the invention in the form of a swashplate machine, shown in longitudinal section.

On the swashplate machine of the invention illustrated in FIG. 4, the sliding shoes 7 are in a functional connection with a moment generating device 25 which generates an opposing moment that counteracts the tipping moment produced by the centrifugal force $F_f$ on the sliding shoes 7. The moment generating device 25 is located between the swashplate 8 and the retaining device 16 formed by the retaining plate 15 in the vicinity of the sliding shoe plates 7*a*. The retaining device 16 illustrated in FIG. 4 is in the form of a non-positive retaining device which, as shown in FIG. 4, is pushed toward the swashplate 8 by means of the spring device 18 and the spherical bearing component 17.

It is also possible, however, to realize the retaining device 15 as illustrated in FIG. 4 in the form of a positive or interlocking retaining device which, as illustrated in FIG. 3, is fastened on the housing 3 in the axial direction.

Figure 5:
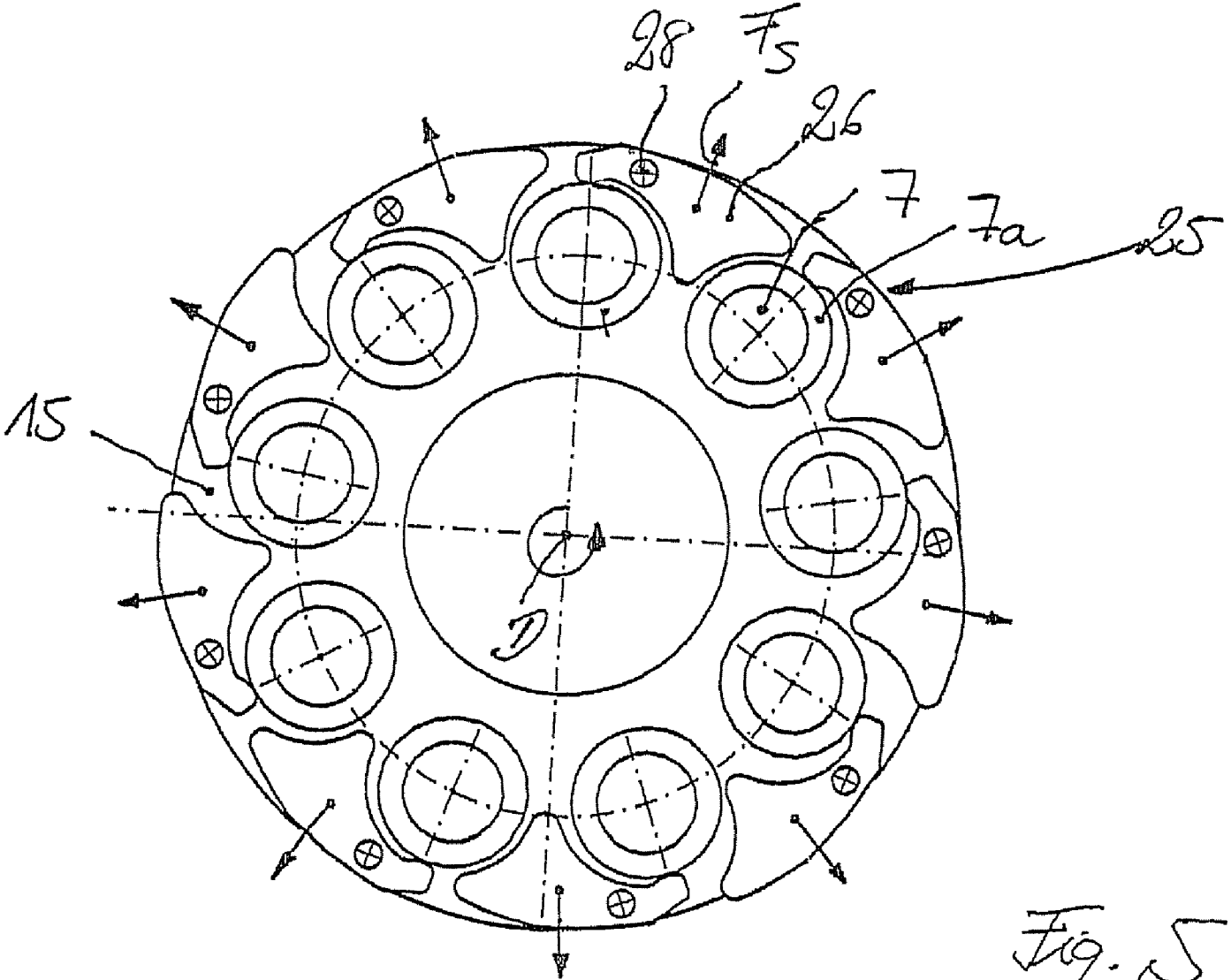
FIG. 5 is a section along line A-A in FIG. 4 with a plan view of the retaining device.

The moment generating device 25 (as shown in FIG. 5 depicting a plan view of the retaining plate 15 and the sliding shoe 7) includes rocker arms 26, with one rocker arm 26 associated with each sliding shoe 7.

Figure 6:
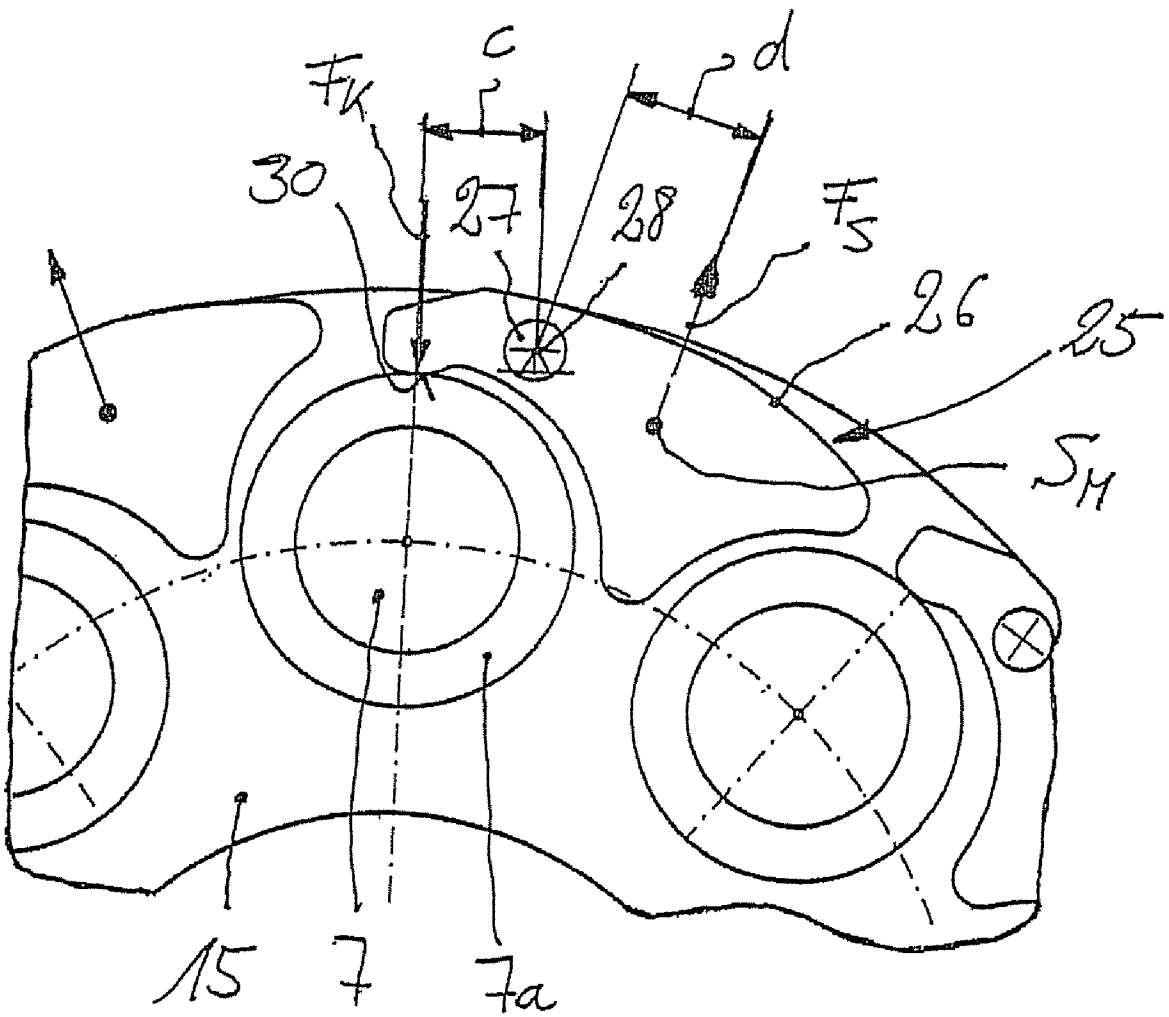
FIG. 6 is an enlarged detail from FIG. 5.

FIG. 6 shows an enlarged detail from FIG. 5. The rocker arm 26 that is associated with a sliding shoe 7 is mounted, e.g., by means of a bearing component 27 in the form of a cylindrical dowel on the outer area of the retaining plate 15 and can be pivoted around a pivoting axis 28 which is oriented parallel to the axis of rotation D (FIG. 5) of the retaining plate 15.

The rocker arm 26 is realized in the form of a two-armed lever, whereby in a first area of the rocker arm, a contact surface 30 is realized which is in a functional connection with the peripheral surface of the sliding shoe 7 in the vicinity of the sliding shoe plate 7*a*. The contact surface 30 is distanced from the pivoting axis 28 by a first lever arm "c". The second area of the rocker arm 26, which is opposite this area with reference to the pivoting axis 28, wraps partway around the sliding shoe and fills up at least part of the space between the two neighboring sliding shoes 7. As a result of this configuration of the rocker arm 26, the center of mass $S_M$ of the rocker arm 26 is located in the second area and is distanced from the pivoting axis 28 by a second lever arm "d". The second lever arm "d" is thereby larger than the first lever arm "c".

During rotation of the cylinder drum 3 around the axis of rotation 2, the retaining plate 15 rotates around the axis of rotation D. A centrifugal force $F_S$ is thereby applied to the center of mass $S_M$ of the rocker arm 26, which with the second lever arm "d" exerts a torque around the pivoting axis 28, which is supported on the contact surface 30 by a contact force $F_k$ which is directed opposite to the centrifugal force $F_S$ and acts on the sliding shoe 7.

As a result of the selection of the lever arms c and d of the rocker arm 26, with a given mass of the rocker arm 26, the contact force $F_k$ is greater than the centrifugal force $F_S$ that acts on the rocker arm 26. As a result of which, a large contact force $F_k$ can be achieved.

Figure 7:
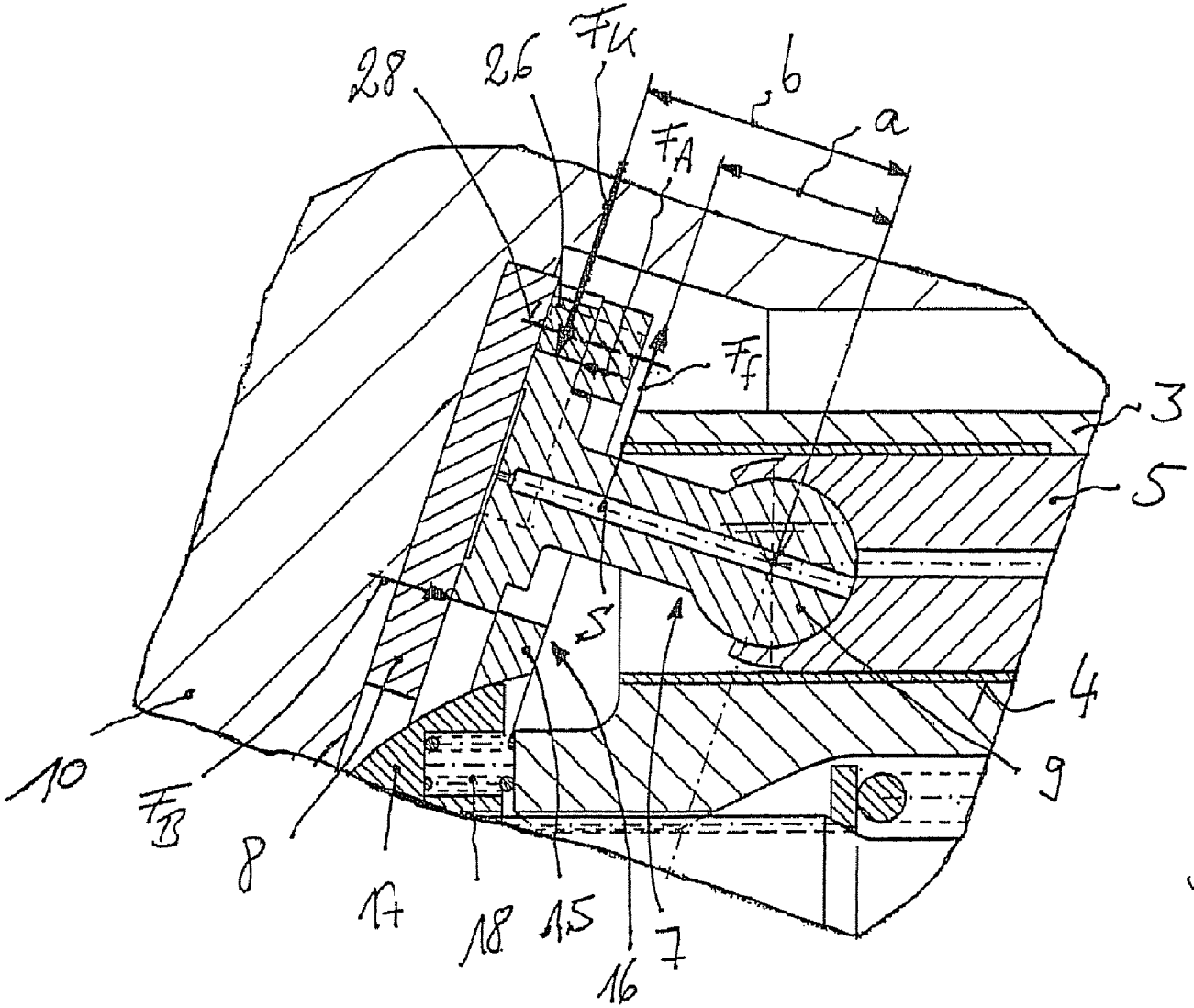
FIG. 7 is an enlarged detail from FIG. 4.

FIG. 7 is a view like the one in FIG. 2 of a sliding shoe of a swashplate machine 1 of the invention, showing the forces acting on the sliding shoe 7.

As shown in FIG. 7, the contact force $F_k$ is generated by the rocker arm 26 and is exerted toward the inside on the peripheral surface of the sliding shoe 7 in the vicinity of the sliding shoe plate 7*a* and is thus directed opposite to the centrifugal force $F_f$ that is exerted on the sliding shoe 7. The contact force $F_k$ that is exerted on the peripheral surface of the sliding shoe 7 in the vicinity of the sliding shoe plate 7*a* thereby is at the distance "b" from the center of the sliding shoe ball-and-socket joint 9. As a result of which, an opposing moment is produced by the contact force $F_k$ at the distance b which counteracts the tipping moment of the sliding shoe 7 formed from the distance "a" and the centrifugal force $F_f$.

The masses of the rocker arm 27 and the lever arms c and d of the rocker arm 26 are preferably designed so that the tipping moment formed by the centrifugal force $F_f$ and the distance "a" is completely or almost completely compensated by the opposing moment exerted by the contact force $F_k$ and the distance "b", so that the sum of the moments around the center of the sliding shoe ball-and-socket joint 9 is zero or nearly zero. As a result of which, the forces $F_A$ and $F_B$ are small, or these forces $F_A$ and $F_B$ disappear altogether.

On a swashplate machine 1 of the invention, the tipping of the sliding shoes 7 from the swashplate 8 is effectively prevented by means of the moment generating device 25. As a result of the contact force $F_k$ that is generated by the rocker arms 26 and thus the opposing moment that is exerted on the sliding shoe 7 and counteracts the tipping moment, in a swashplate machine 1 of the invention with a non-positive retaining device 16, the spring force of the spring device 18 which acts on the retaining plate 15 and pushes the sliding shoe 7 against the swashplate 8 can be reduced. As a result of which, low friction forces are present between the sliding shoes 7 and the swashplate 8 and, thus, a high degree of efficiency can be achieved in a swashplate machine 1 of the invention. Low wear can also be achieved in a swashplate machine 1 of the invention with a moment generating device 25 formed by the rocker arms 26.

In a swashplate machine 1 provided with a moment generating device 25 formed by the rocker arms 26, with a positive or interlocking retaining device 16, a tipping of the sliding shoes 7 on account of the play in the fastening device of the retaining device 16 in the housing 10 can be effectively prevented by the opposing moment generated by the rocker arms. As a result of which, an increase in leakage is effectively prevented and the swashplate machine of the invention has a high degree of efficiency.

On a swashplate machine 1 of the invention with the moment generating device 25, the contact force between the piston 5 and the cylinder bore 4 caused by centrifugal force is also reduced. As a result of which, a jamming of the piston 5 in the cylinder bore 4 can be effectively prevented.

Instead of locating the rocker arms 26 between the swashplate 8 and the retaining plate 15 in the vicinity of the sliding shoe plates 7*a*, it is also possible to locate the rocker arms 26 on the side of the retaining plate 15 facing the cylinder drum 3. The rocker arms 26 are therefore in a functional connection by means of the contact surface 30 with the neck 7*b* of the sliding shoe 7 which is located between the gliding shoe ball-and-socket joint 9 and the sliding shoe plate 7*a*.

It will be readily appreciated by those skilled in the art that modifications may be made to the invention without departing from the concepts disclosed in the foregoing description. Accordingly, the particular embodiments described in detail herein are illustrative only and are not limiting to the scope of the invention, which is to be given the full breadth of the appended claims and any and all equivalents thereof.

The invention claimed is:

1. An axial piston machine, comprising:

a cylinder drum rotatably around an axis of rotation, wherein the cylinder drum includes cylinder bores; and a longitudinally disposable piston mounted in each cylinder bore, wherein the pistons are each supported by a sliding shoe on a swashplate, wherein the sliding shoes are in a functional connection by a retaining device comprising a retaining plate that rotates synchronously with the cylinder drum, and wherein the sliding shoes are in a functional connection with a moment generating device, by means of which an opposing moment is generated on the sliding shoes from a centrifugal force that counteracts a tipping moment.

2. The axial piston machine as recited in claim 1, wherein the retaining device is pushed toward the swashplate by a spring device.

3. The axial piston machine as recited in claim 1, wherein the retaining device is supported on a housing of the axial piston machine.

4. An axial piston machine, comprising:

a cylinder drum rotatably around an axis of rotation, wherein the cylinder drum includes cylinder bores; and a longitudinally disposable piston mounted in each cylinder bore., wherein the pistons are each supported by a sliding shoe on a swashplate, wherein the sliding shoes are in a functional connection by a retaining device comprising a retaining plate that rotates synchronously with the cylinder drum, and wherein the sliding shoes are in a functional connection with a moment generating device, by means of which an opposing moment is generated on the sliding shoes that counteracts a tipping moment, wherein the moment generating device comprises at least one rocker arm associated with each sliding shoe, by means of which a contact force ($F_k$) that is exerted on the sliding shoe is generated opposite a centrifugal force ($F_f$) that is exerted on the sliding shoe.

5. The axial piston machine as recited in claim 4, wherein the rocker arm is mounted on the retaining device so that it is pivotable around a pivoting axis oriented parallel to an axis of rotation of the retaining device and can be brought into a functional connection with the peripheral surface of the sliding shoe.

6. The axial piston machine as recited in claim 5, wherein the rocker arm can be brought into a functional connection with the peripheral surface of the sliding shoe in the vicinity of a sliding shoe plate of the sliding shoe.

7. The axial piston machine as recited in claim 5, wherein the rocker arms are located between the retaining device and the swashplate.

8. The axial piston machine as recited in claim 5, wherein a bearing component is provided for mounting the rocker arm on the retaining device.

9. The axial piston machine as recited in claim 4, wherein the rocker arm includes a two-armed lever, wherein a contact surface which can be brought into connection with the sliding shoe is provided on an area of the rocker arm which is provided with a first lever arm, and a center of mass of the rocker arm is applied to a second lever arm.

10. The axial piston machine as recited in claim 9, wherein the second lever arm is larger than the first lever arm.

11. The axial piston machine as recited in claim 9, wherein the mass of the rocker arm and the first lever as well as the second lever arm are designed so that the opposing moment generated by the rocker arm compensates completely or almost completely for a tipping moment exerted on the sliding shoe.

12. The axial piston machine as recited in claim 9, wherein the rocker arm partly surrounds the sliding shoe and the area of the rocker arm that is provided with the second lever arm at least partly fills the space between two neighboring sliding shoes.

* * * * *

UNITED STATES PATENT AND TRADEMARK OFFICE

CERTIFICATE OF CORRECTION

PATENT NO. : 8,037,808 B2
APPLICATION NO. : 12/241237
DATED : October 18, 2011
INVENTOR(S) : Martin Bergmann It is certified that error appears in the above-identified patent and that said Letters Patent is hereby corrected as shown below:

Column 7, Line 12, Claim 4, delete "bore.," and insert -- bore, --

Signed and Sealed this
Twentieth Day of March, 2012

David J. Kappos

David J. Kappos
*Director of the United States Patent and Trademark Office*